US006193485B1

(12) United States Patent
Ueda et al.

(10) Patent No.: US 6,193,485 B1
(45) Date of Patent: Feb. 27, 2001

(54) SEAL STRUCTURE FOR CASING

(75) Inventors: Shusaku Ueda; Takeshi Inoue; Kenichi Hashimoto; Kazutaka Hori, all of Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/242,668

(22) PCT Filed: Jun. 25, 1998

(86) PCT No.: PCT/JP98/02879

§ 371 Date: Feb. 22, 1999

§ 102(e) Date: Feb. 22, 1999

(87) PCT Pub. No.: WO99/01664

PCT Pub. Date: Jan. 14, 1999

(30) Foreign Application Priority Data

Jul. 3, 1997 (JP) ..... 9-178183

(51) Int. Cl.[7] ..... F01C 1/04; F01C 21/10; F01M 1/00

(52) U.S. Cl. ..... 418/55.1; 418/149; 417/902

(58) Field of Search ..... 418/55.1, 149, 418/270; 417/902; 29/888.022

(56) References Cited

U.S. PATENT DOCUMENTS

| | | | | |
|---|---|---|---|---|
| 3,285,504 | * | 11/1966 | Smith | 417/902 |
| 4,552,518 | | 11/1985 | Utter | 418/97 |
| 5,382,143 | * | 1/1995 | Nakamura et al. | 418/55.1 |

FOREIGN PATENT DOCUMENTS

| | | | | |
|---|---|---|---|---|
| 2546877 | | 8/1966 | (JP) . | |
| 54-87910 | | 7/1979 | (JP) . | |
| 59-135390 | | 9/1984 | (JP) . | |
| 60-190690 | | 9/1985 | (JP) . | |
| 62-291489 | * | 12/1987 | (JP) | 418/149 |
| 62-291490 | * | 12/1987 | (JP) | 418/149 |
| 1-254562 | | 10/1989 | (JP) . | |
| 2-5779 | * | 1/1990 | (JP) | 418/55.1 |
| 2-72376 | | 6/1990 | (JP) . | |
| 3-264788 | * | 11/1991 | (JP) | 418/55.1 |
| 5-157066 | | 6/1993 | (JP) . | |
| 6-26468 | * | 2/1994 | (JP) | 418/55.1 |
| 6-122462 | | 5/1994 | (JP) . | |
| 6-65880 | | 8/1994 | (JP) . | |
| 6-272677 | * | 9/1994 | (JP) | 418/55.1 |
| 7-158577 | | 6/1995 | (JP) . | |
| 7-310677 | | 11/1995 | (JP) . | |
| 08247048 | | 9/1996 | (JP) . | |
| 9-032771 | | 2/1997 | (JP) . | |
| 63-151431 | * | 10/1998 | (JP) . | |

* cited by examiner

*Primary Examiner*—John J. Vrablik
(74) *Attorney, Agent, or Firm*—Burns, Doane, Swecker & Mathis LLP

(57) ABSTRACT

An upper casing is outer-fitted to a lower casing. A concave portion for receiving a peripheral portion of a housing is provided at an inner wall of the upper casing. A convex portion for suppressing deformation of the housing caused by deformation when the upper casing is shrinkage-fitted or pressed-fitted is selectively formed at the bottom of the concave portion. A gap is provided between the lower casing and the housing for alleviating the degree of press on the housing by the casing when the upper casing and the lower casing are welded.

11 Claims, 4 Drawing Sheets

Applied Art

Applied Art

SEAL STRUCTURE FOR CASING

TECHNICAL FIELD

The present invention relates to a sealing structure of a casing, and more particularly, to a sealing structure between a partition member and a casing in the case where there are both a high pressure chamber and a low pressure chamber divided by the partition member in the casing.

BACKGROUND ART

FIGS. 4 and 5 show a sealing structure of a casing of a conventional scroll fluid machine. FIG. 4 shows a scroll fluid machine disclosed in Japanese Patent Publication No. 6-65880 (Japanese Patent Laying-Open No. 60-190690), and FIG. 5 shows a scroll fluid machine disclosed in Japanese Patent Laying-Open No. 7-310677. For the purposes of convenience, components in FIGS. 4 and 5 related to those of the invention of the present application have reference characters allotted, and the labels thereof will be appropriately altered corresponding to the components of the invention of the present application.

Referring to FIG. 4, the casing of the scroll fluid machine is constituted by an upper casing 2*a* and a lower casing 2*b*. A fixed scroll 3, a movable scroll 4, a housing 5, a crank shaft 6, and a motor 22 are incorporated within the casing.

A compression chamber 15 for compressing gas refrigerant is formed of fixed scroll 3 and movable scroll 4. Movable scroll 4 includes a boss unit 4*a* and an outlet 4*b* for discharging compressed gas refrigerant. Crank shaft 6 includes an eccentric unit 6*a* into which boss unit 4*a* is inserted. A bearing metal 7*a* is provided between boss unit 4*a* and eccentric unit 6*a*.

Motor 22 includes a rotor 21 and a stator 20. Crank shaft 6 is inserted inside rotor 21. The peripheral portion of housing 5 is sandwiched between upper housing 2*a* and lower housing 2*b*. An O-ring 24 for sealing is attached at the boundary between housing 5 and upper casing 2*a*. A suction pipe 10 and a discharge pipe 23 are attached to the casing. The compressed gas refrigerant is discharged outside according to the open arrow in FIG. 4.

Referring to the conventional art of FIG. 5, a notch stepped portion 25 is provided in upper casing 2*a* to receive a peripheral portion 5*a* of housing 5. The lower end of upper casing 2*a* is fixed to the outer circumferential face of lower casing 2*b* by a welding portion 13. Housing 5 is secured by a spot welding portion 13*a*.

In the conventional art of FIG. 4, an O-ring 24 is provided between housing 5 and upper casing 2*a*. The usage of O-ring 24 induces the problem of increase in cost. In the case of FIG. 4, reduction in the spacing in the casing is a matter of concern since the open end of upper casing 2*a* is fitted into the inner side of the opening end of lower casing 2*b*.

In contrast, the problem of increase in cost due to usage of an O-ring is not encountered in the conventional case of FIG. 5 since no O-ring is used. Furthermore, the problem of reduction in the spacing in the casing is eliminated since upper casing 2*a* is outer-fitted to lower casing 2*b*. However, a welding process is carried out with respect to upper casing 2*a* and lower casing 2*b*. There is a possibility that housing 5 is deformed caused by deformation of upper and lower casings 2*a* and 2*b* by the welding process.

DISCLOSURE OF THE INVENTION

The present invention is directed to solve the above problems. An object of the present invention is to provide a sealing structure of a casing that can have increase in cost suppressed by providing sealing between the casing and a housing member abutted on the inner wall of the casing without using an O-ring, and that can have deformation of the housing member caused by shrinkage-fitting or press-fitting and welding suppressed.

According to a sealing structure of a casing of the present invention, the casing includes a first casing, a second casing that is outer-fitted to the outer circumferential face of the first casing, and a housing member held by the first casing and having the outer circumferential face abutted on the inner wall of the second casing. A convex portion is formed at at least one of the outer circumferential face of the housing member and the inner circumferential face of the second casing . The second casing is shrinkage-fitted or press-fitted to the housing member. By this shrinkage-fitting or press-fitting, the convex portion is deformed to provide sealing between the inner circumferential face of the second casing and the outer circumferential face of the housing member.

As described above, the second casing is shrinkage-fitted or press-fitted to the housing member. Accordingly, the convex portion is deformed. The outer circumferential face of the housing member and the inner wall of the second casing can abut each other hermetically to allow sealing between the outer circumferential face of the housing member and the inner wall of the casing. As a result, it is not necessary to provide an O-ring between the outer circumferential face of the housing member and the inner wall of the casing. Therefore, the cost can be reduced. Furthermore, since a convex portion is selectively provided at at least the outer circumferential face of the housing member or the inner wall of the second casing, the convex portion is pressed by the outer circumferential face or the inner wall at the time of shrinkage-fitting or press-fitting to be deformed with priority. More specifically, the compressive stress exerted to the housing member in the shrink-fitting or press-fitting process can be made to concentrate at the convex portion. Accordingly, the amount of deformation of the housing member itself caused by the shrinkage-fitting or press-fitting can be reduced effectively.

The above-described casing is preferably a casing of a scroll fluid machine in which both a high pressure chamber and a low pressure chamber are present during operation of the scroll fluid machine. The high pressure chamber and the low pressure chamber are partitioned by the peripheral portion of the housing member. The peripheral portion of the housing member is mounted on the end face located at the opening side of the first casing. A concave portion for receiving the peripheral portion of the housing member is provided at the inner wall of the second casing. The peripheral portion of the housing member is sandwiched by the wall face of the concave portion and the end face of the first casing.

As described above, there are both a high pressure chamber and a low pressure chamber in a casing, and a concave portion is provided at the inner wall of the second casing to receive the peripheral portion of the housing member. Accordingly, the peripheral portion of the housing member can be made to abut against the wall face of the concave portion by the difference in pressure between the high pressure chamber and the low pressure chamber. As a result, the sealing performance between the peripheral portion of the housing member and the inner wall of the casing can be further improved.

The above casing is a casing of a scroll fluid machine in which the second casing and the first casing are welded. A deformation suppression portion for suppressing deformation of the main body of the housing member according to deformation of the casing caused by the above welding is provided between the casing and the housing member.

As described above, the second casing and the first casing are welded, and a deformation suppression portion for suppressing deformation of the main body of the housing member is provided between the casing and the housing member. A gap provided between the housing member and the casing is an example of the deformation suppression portion. The provision of such a gap allows alleviation of the degree of press to the housing member body from the casing when the casing is deformed inwards by welding. Therefore, the amount of deformation of the housing member body caused by welding can be suppressed to a minimum.

BEST MODE FOR CARRYING OUT THE INVENTION

Figure 1:
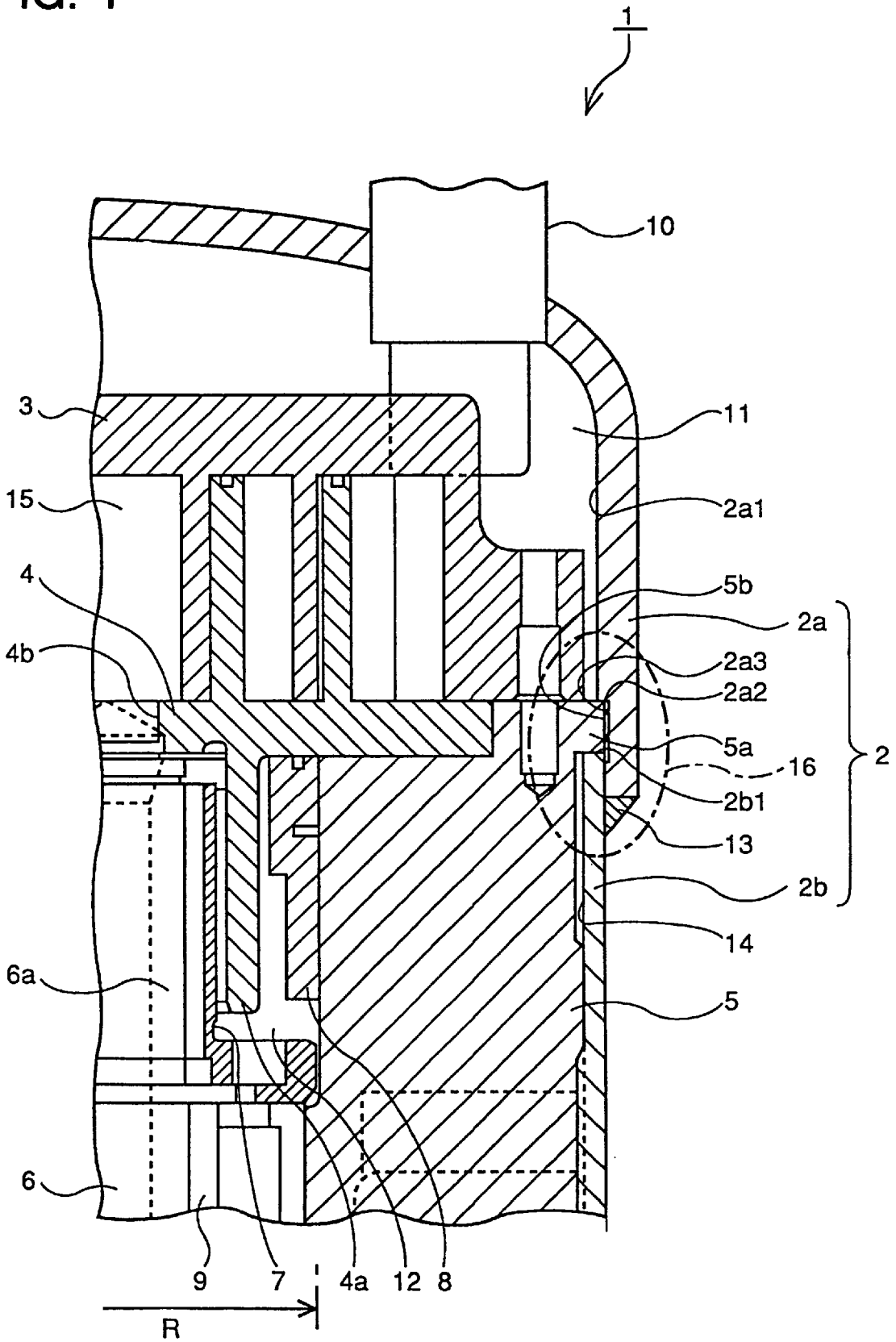
FIG. 1 is a partial sectional view of a scroll fluid machine according to a first embodiment of the present invention.

One embodiment of applying the concept of the present invention into a scroll fluid machine will be described hereinafter with reference to FIGS. 1–3. FIG. 1 is a partial sectional view of a scroll fluid machine according to one embodiment of the present invention.

Referring to FIG. 1, a scroll fluid machine 1 includes a closed casing 2. Closed casing 2 includes an upper casing 2*a* and a lower casing 2*b*. Upper casing 2*a* is outer-fitted to lower casing 2*b*. In the present case, upper casing 2*a* is shrinkage-fitted to housing (housing member) 5. The lower end (opening end) of upper casing 2*a* is attached to the outer circumferential face of lower casing 2*b* via a welding portion 13.

A fixed scroll 3, a movable scroll 4, a housing 5, and a crank shaft 6 are incorporated in closed casing 2. A compression chamber 15 is formed by fixed scroll 3 and movable scroll 4. An outlet 4*b* for sending compressed gas refrigerant to a discharge gas passage provided within crank shaft 6 is formed at movable scroll 4. A boss unit 4*a* is provided at the back side of movable scroll 4. An eccentric unit 6*a* of crank shaft 6 is inserted inside boss unit 4*a*. A slide bush 7 is inserted between eccentric unit 6*a* and boss unit 4*a*. Crank shaft 6 is held by housing 5 through a rolling bearing 9. A seal ring 8 is provided around boss unit 4*a*. A suction pipe 10 is attached to upper casing 2*a* to feed gas refrigerant into compression chamber 15.

A high pressure chamber 12 and a low pressure chamber 11 are present within closed casing 2 during operation of scroll fluid machine 1. High pressure chamber 12 and low pressure chamber 11 are partitioned by housing 5.

According to the above structure, a concave portion 2*a*2 for receiving a peripheral portion 5*a* of housing 5 is provided at an inner wall 2*a*1 of upper casing 2*a* . A convex portion 2*a*3 is provided at the bottom of concave portion 2*a*2. Convex portion 2*a*3 preferably has an annular configuration to be pressed by the outer circumferential face of peripheral portion 5*a* of housing 5 to be deformed when upper casing 2*a* is shrinkage-fitted. In other words, the compressive force exerted to housing 5 is concentrated at convex portion 2*a*3 according to deformation of upper casing 2*a* caused by shrinkage-fitting. Therefore, the amount of deformation of the main body of housing 5 caused by shrinkage-fitting of upper casing 2*a* can be minimized. Specifically, the inventors of the present application confirmed that the amount of deformation in the inner diameter R of the housing when concave portion 2*a*3 is not formed is 100 $\mu$m whereas the amount of deformation in the inner diameter R is significantly reduced to 20 $\mu$m due to formation of convex portion 2*a*3.

Furthermore, the above-described shrinkage-fitting allows sealing between upper casing 2*a* and peripheral portion 5*a* of housing 5 without the provision of an O-ring. Therefore, the O-ring is dispensable to allow reduction in the cost.

Figure 2:
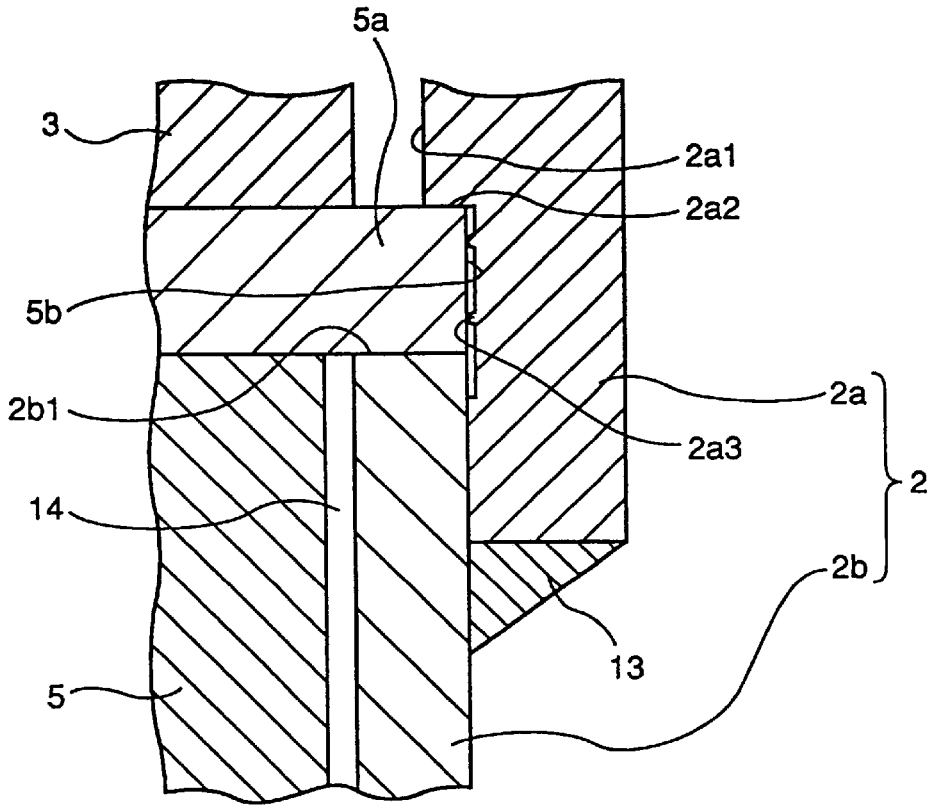
FIG. 2 is a an enlarged sectional view of a region 16 of FIG. 1.
Figure 3:
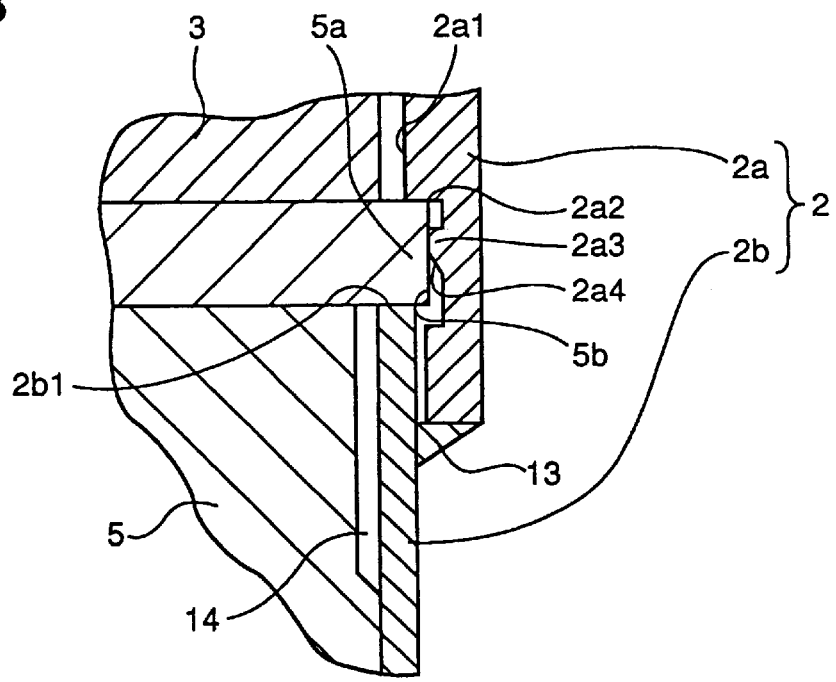
FIG. 3 is a sectional view showing an example of a structure applicable to press-fit the upper casing to the lower casing.
Figure 4:
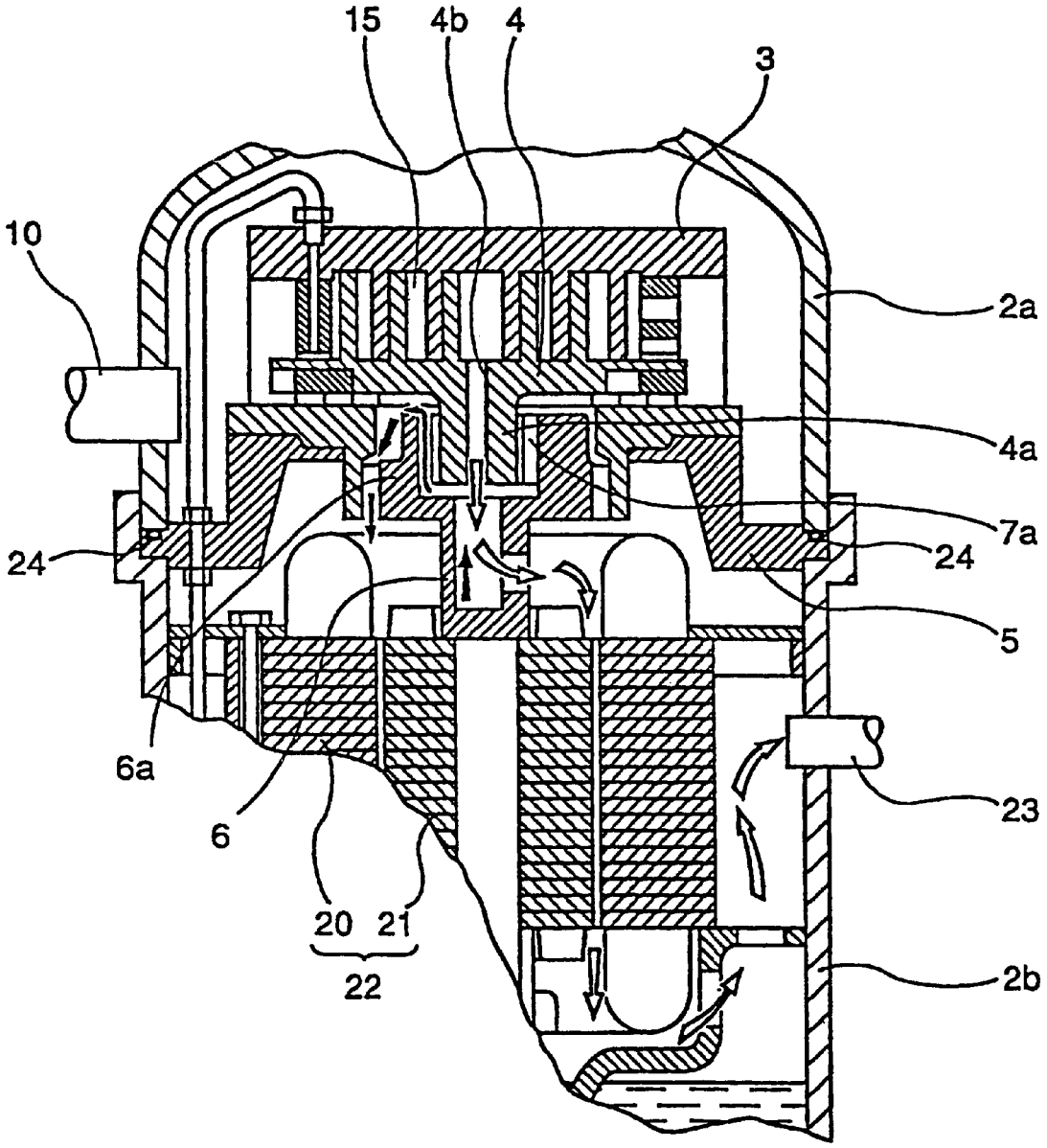
FIG. 4 is a partial sectional view of an example of a conventional scroll fluid machine.
Figure 5:
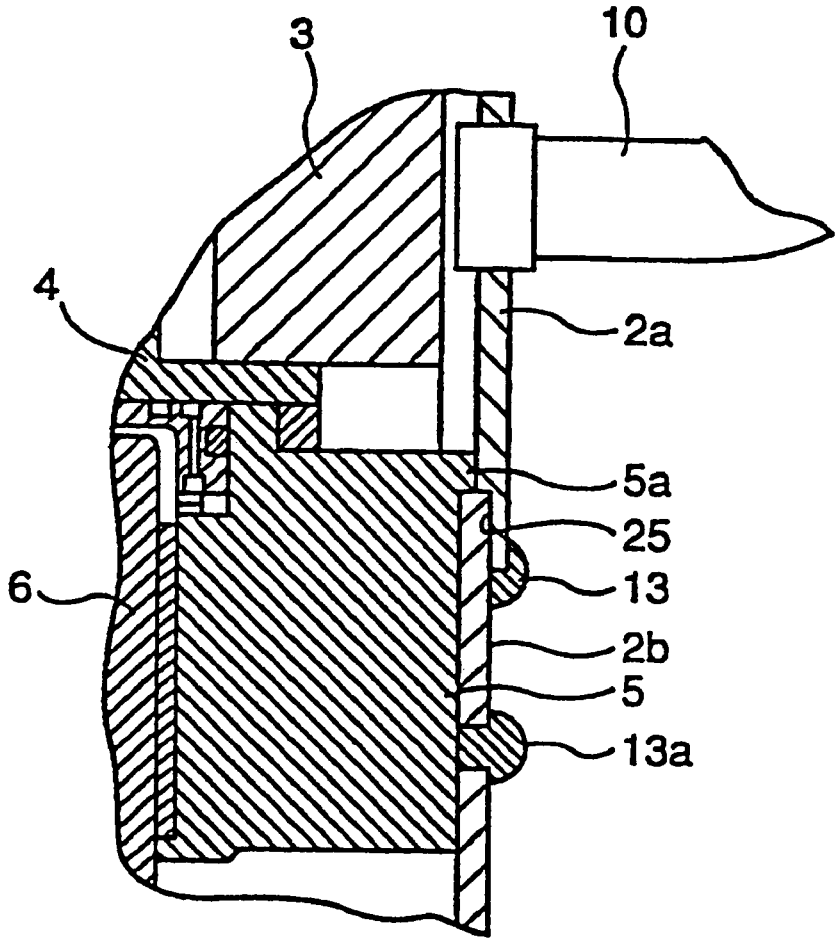
FIG. 5 is a partial sectional view of another example of a conventional scroll fluid machine.

FIG. 2 shows an enlargement of a region 16 of FIG. 1. As shown in FIG. 2, two convex portions 2*a*3 are provided at the bottom of concave portion 2*a*2. The number of concave portions can be selected arbitrarily. FIGS. 1 and 2 are illustrated with a gap between outer circumferential face 5*b* of peripheral portion 5*a* and the bottom of concave portion 2*a*2. However, there may also be the case where there is almost no gap if convex portion 2*a*3 is substantially crushed. Convex portion 2*a*3 can be provided at the outer circumferential face 5*b* side of peripheral portion 5*a* of housing 5. In the case where the outer circumferential face of fixed scroll 3 abuts on inner wall 2*a*1 of upper casing 2*a,* convex portion 2*a*3 can be provided at the outer circumferential face of fixed scroll 3.

Referring to FIGS. 1 and 2 again, peripheral portion 5*a* is mounted on an end face 2*b*1 at the opening end side of lower casing 2*b* to divide high pressure chamber 12 from low pressure chamber 11. Accordingly, the upper end face of peripheral portion 5*a* is pressed towards the wall of concave portion 2*a*2 due to the pressure difference between high pressure chamber 12 and low pressure chamber 11. This contributes to improving the sealing performance between peripheral portion 5*a* and upper casing 2*a*.

A gap 14 is provided at the outer circumference of housing 5 as shown in FIGS. 1 and 2. By providing such a gap 14, the amount of deformation of housing 5 caused by deformation of casing 2 during welding of upper casing 2*a* and lower casing 2*b* can be suppressed to a low level. In other words, gap 14 functions as the deformation suppression means for the body of housing 5.

In the example shown in FIGS. 1 and 2, deformation of lower casing 2*b* inwardly to press housing 5 is a matter of concern when upper and lower casings 2*a* and 2*b* are welded. In this case, the provision of gap 14 at the outer circumference of housing 5 and in the proximity of welding portion 13 allows the degree of pressing on housing 5 caused by deformation of lower casing 2*b* to be alleviated. Accordingly, it is considered that the amount of deformation of housing 5 caused by welding of upper and lower casings 2*a* and 2*b* can be suppressed at a minimum level.

The inventors of the present application compared the amount of deformation in the inner diameter R of housing 5 corresponding to the cases with and without gap 14. It was confirmed that the amount of deformation of inner diameter R was 25 $\mu$m for the case where gap 14 was not provided whereas the amount of deformation of inner diameter R was significantly reduced to 7 $\mu$m for the case where gap 14 was provided.

The above gap 14 can be formed by cutting away the outer circumference of housing 5. Alternatively, gap 14 can be formed by cutting away the inner wall of lower casing 2*b*. Furthermore, in the case where the outer circumferential face of fixed scroll 3 abuts on inner wall 2*a*1 of upper casing 2*a*, a gap can be formed between fixed scroll 3 and upper casing 2*a* to effectively suppress the press on fixed scroll 3 caused by deformation of upper casing 2*a* by welding.

An embodiment of press-fitting upper casing 2*a* to lower casing 2*b* will be described with reference to FIG. 3. In this case, a chamfer portion 2*a*4 is formed at convex portion 2*a*3 provided at the bottom of concave portion 2*a*2. Accordingly, upper casing 2*a* can be pressed-fitted smoothly. Similar to the above-described case for shrinkage-fitting, the sealing performance between inner wall 2*a*1 of upper casing 2*a* and outer circumferential face 5*b* of peripheral portion 5*a* of housing 5 can be ensured by this press-fitting. It is to be noted that convex portion 2*a*3 can be formed small enough to be scrapped off at the time of press-fitting.

Although the embodiments of the present invention have been described as above, it is to be understood that the embodiments disclosed here are by way of example in all issues and is not to be taken by way of limitation. It is intended that the range of the present invention is indicated by the accompanying claims, including all modifications equivalent to and within metes and bounds of the claims.

Industrial applicability

The present invention can be effectively applied to a sealing structure of a casing with both a high pressure chamber and a low pressure chamber internally.

What is claimed is:

1. A casing having a sealing structure comprising a first casing, a second casing having a step portion and outer-fitted to an outer circumferential face of said first casing, and a housing member held by said first casing and having an outer circumferential face fitted within the step portion of said second casing, wherein at least one convex portion is formed in one of the step portion of said second casing and the outer circumferential face of said housing member, and said second casing is shrinkage-fitted or pressed-fitted to said housing member, said convex portion being deformed by said shrinkage-fitting or press-fitting to provide sealing between said inner circumferential face of said second casing and said outer circumferential face of said housing member.

2. The casing according to claim 1, wherein said convex portion is annular.

3. The casing according to claim 1, wherein a plurality of said convex portions are provided.

4. The casing according to claim 1, wherein a chamfer portion is provided at a surface of said convex portion located at an opening side of said second casing.

5. The casing according to claim 1, wherein said casing is a casing of a scroll fluid machine, a high pressure chamber and a low pressure chamber are both present within said casing (2) during operation of said scroll fluid machine, said high pressure chamber and said low pressure chamber are partitioned by a peripheral portion of said housing member, said peripheral portion of said housing member is mounted on an end face located at an opening end side of said first casing, a concave portion for receiving the peripheral portion of said housing member is provided at an inner circumferential face of said second casing, and said peripheral portion of said housing member is sandwiched by a wall of said concave portion and said end face of said first casing.

6. The casing according to claim 5, wherein a movable scroll and a fixed scroll are incorporated within said casing, and said housing member supports said movable scroll and said fixed scroll.

7. The casing according to claim 6, wherein said convex portion is provided at an outer circumferential face of said fixed scroll.

8. The casing according to claim 1, wherein said casing is a casing of a scroll fluid machine, said second casing and said first casing are attached by welding, and deformation suppression means for suppressing deformation of a main body of said housing member according to deformation of said casing by said welding is provided between said casing (2) and said housing member.

9. The casing according to claim 8, wherein said deformation suppression means is a gap provided between said casing and said housing member.

10. The casing according to claim 9, wherein said gap is formed by cutting away at least one of the inner wall of said casing and the outer circumferential face of said housing member, and provided in proximity to a weld portion.

11. The casing according to claim 9, wherein a movable scroll and a fixed scroll are incorporated within said casing, said housing member supports said movable scroll and said fixed scroll, and a gap is provided between said fixed scroll and said casing.

* * * * *